US007178430B2

(12) United States Patent
Butz

(10) Patent No.: US 7,178,430 B2
(45) Date of Patent: Feb. 20, 2007

(54) VOLUME DAMPER ADJUSTMENT TOOL

(76) Inventor: Bruno Butz, 8501 S. Tripp Ave., Chicago, IL (US) 60652

( * ) Notice: Subject to any disclaimer, the term of this patent is extended or adjusted under 35 U.S.C. 154(b) by 168 days.

(21) Appl. No.: 11/093,190

(22) Filed: Mar. 29, 2005

(65) Prior Publication Data

US 2006/0219064 A1 Oct. 5, 2006

(51) Int. Cl.
*B25B 13/00* (2006.01)
*B25B 13/58* (2006.01)
*B25G 3/02* (2006.01)

(52) U.S. Cl. ..... 81/124.2; 81/28; 81/35; 81/73; 81/184

(58) Field of Classification Search ..... 81/124.2, 81/489, 177.1, 28, 35, 73, 177.2, 184, 124.4, 81/124.5

See application file for complete search history.

(56) References Cited

U.S. PATENT DOCUMENTS

| | | | | |
|---|---|---|---|---|
| 2,224,208 | A | 12/1940 | Acer | |
| 2,342,877 | A | 2/1944 | Maage, Jr. | |
| 2,790,343 | A * | 4/1957 | White | 81/55 |
| 3,009,473 | A | 11/1961 | Hennen | |
| 3,734,114 | A | 5/1973 | Phillips | |
| 3,889,558 | A * | 6/1975 | Duncan | 81/55 |
| 3,921,900 | A | 11/1975 | Cole | |
| 4,108,371 | A | 8/1978 | Leemhuis | |
| 4,137,895 | A | 2/1979 | Bittinger | |
| 4,147,298 | A | 4/1979 | Leemhuis | |
| 4,294,226 | A | 10/1981 | Feinberg | |
| 4,295,486 | A | 10/1981 | McCabe | |
| 4,949,625 | A | 8/1990 | Miklos | |
| 6,561,895 | B2 | 5/2003 | McGill | |
| 6,598,500 | B1 * | 7/2003 | Chivington | 81/55 |

* cited by examiner

*Primary Examiner*—Lee D. Wilson
*Assistant Examiner*—Bryan R. Muller
(74) *Attorney, Agent, or Firm*—Meroni & Meroni, P.C.; Charles F. Meroni, Jr.; Christopher J. Scott

(57) ABSTRACT

A tool adjusts a damper assembly having a pivot arm and an arm fastener. The tool comprises an inner elongate member, an outer elongate member, and bushing collars. The inner member is telescopically received in the outer member. The inner and outer members each comprise a first member end, a second inner member end, and a member axis. The first inner member end comprises a fastener adjuster and the first outer member end comprises a pivot arm adjuster. The bushing collars are cooperatively associated with the first outer member end, the second outer member end, and an outer member surface of the inner member for maintaining the inner and outer member axes in collinear relation for forming a reach axis. The inner and outer members are each rotatable about the reach axis. The fastener adjuster adjusts the arm fastener and the pivot arm adjuster adjusts the pivot arm.

19 Claims, 2 Drawing Sheets

VOLUME DAMPER ADJUSTMENT TOOL

BACKGROUND OF THE INVENTION

1. Field of the Invention

The present invention generally relates to a tool for enabling a user to adjust air volume dampers associated with HVAC ductwork. More particularly, the present invention relates to a tool for enabling users thereof to adjust air volume dampers commonly associated with forced air duct systems located in remote, otherwise hard to reach, spatial locations.

2. Description of the Prior Art

Heating, ventilation, and air-conditioning (HVAC) systems are well known in the art. Further, it is noted that various means have been devised to control the volume of air flowing through forced air ventilation systems. For state of the art references, the reader is casually directed to U.S. Pat. No. 2,224,208, which issued to Acer ('208 Patent); U.S. Pat. No. 2,342,877, which issued to Maage, Jr. ('877 Patent); U.S. Pat. No. 3,009,473, which issued to Hennen ('473 Patent); U.S. Pat. No. 3,734,114, which issued to Phillips (''114 Patent); U.S. Pat. No. 3,921,900, which issued to Cole ('900 Patent); U.S. Pat. No. 4,108,371, which issued to Leemhuis ('371 Patent); U.S. Pat. No. 4,294,226, which issued to Feinberg ('226 Patent); U.S. Pat. No. 4,295,486, which issued to McCabe (''486 Patent); U.S. Pat. No. 4,949,625, which issued to Miklos ('625 Patent); and U.S. Pat. No. 6,561,895, which issued to McGill ('895 Patent).

It will be seen from an inspection of the noted disclosures that HVAC systems typically comprise a series of forced air ducts and any number of volume dampers for adjusting the volume of air flow directed through the ductwork. To adjust the air flow through forced air ductwork, the volume dampers comprise adjustment means. However, when the adjustment means are not self-directing, and must be adjusted by an on-site technician, the on-site technician often finds that adjustable volume dampers are often situated in hard to reach areas.

HVAC systems are typically located immediately adjacent either ceilings or walls, which often require the on-site technician to use a ladder or some other similar means to gain close access to duct work to adjust volume flow of air through different duct work. With the exception of the '895 patent, none of the prior art disclosures hereinabove noted teaches means for remotely and manually adjusting a volume damper assembly. From a close inspection of the '895 patent, it will be seen that the disclosure teaches a damper for an air flow system opening, such as the air inlet of a clean room filter module, and includes a number of control plates reciprocally mounted on holding elements and a drive element. Notably, the '895 patent further teaches a tool usable to manually and remotely rotate a threaded end of the drive element rotatably held in an opening in a beam by holders. The threaded end of the drive element cooperates with an internally threaded opening in a non-round shaped traveler passing through matching non-round openings in the control plate.

From a review of the foregoing prior art disclosures and from a general consideration of other well known prior art teachings, it will be seen that the prior art does not disclose a a volume damper tool assembly for enabling a user to adjust a selectively fastenable pivot arm as an external part of a volume damper assembly, which volume damper tool assembly comprises a rotatable inner member telescopically received in a rotatable outer member, and which inner member comprises a first inner member end, a second inner member end, an inner member axis, and an outer member surface, and which outer member comprises a first outer member end, a second outer member end, an outer member axis, and an inner member surface. The prior art further does not appear to teach a tool assembly wherein the outer member surface is movable relative to the inner member surface and in which the inner and outer member axes are substantially collinear for forming a reach axis, the inner and outer members each being selectively rotatable about the reach axis for attending to tasks at the first member ends. The prior art thus perceives a need for the briefly described structure or tool assembly.

SUMMARY OF THE INVENTION

When manually adjustable damper assemblies require adjustment, it is contemplated that the on-site technician may easily complete the task by utilizing the present invention. Thus it is an object of the present invention to provide a tool assembly for enabling users thereof to adjust remotely situated volume damper assemblies. Typically comprising a reach axis of about six (6) feet, the present invention enables users to reach remotely-situated damper assemblies (i.e. remotely-situated within about 6 feet).

It is a further object of the present invention to provide a simultaneous multitasking tool. For example, in cases where multiple tools may be simultaneously utilized for assembly of products, one tool may be attached to an inner elongate member for performing one task while at the same time another tool may be attached to an outer elongate member for performing a different task (the inner elongate member being telescopically received in the outer elongate member).

Further, it is an object of the present invention to provide a drive socket mechanism cooperatively associated with an inner elongate member, while an outer elongate member (telescopically receiving the inner elongate member) has a hold-down type bracket to keep parts in place while the inner elongate member is turned to tighten or loosen a fastener in hard to reach situations.

To achieve these and other readily apparent objectives, the present invention essentially provides a two tube assembly, including an outer tube for holding an arm. The arm functions as a holder for a volume damper arm. The inside tube actually slides within the outer tube and may comprise any number of drive sockets at its tip for loosening and tightening set screws or similar other structure.

Thus the problem of obstacles obstructing one's path (including the obstacle of distance) to a volume damper assembly may be effectively overcome using the "two-tube" assembly of the present invention. More particularly, the present invention discloses a volume damper adjustment tool for enabling a user to adjust at least one remote damper assembly, the damper assembly comprising inner duct damper means and an outer duct pivot arm, the outer duct pivot arm comprising arm fastening means. The outer duct pivot arm is designed to adjust the inner duct damper means and the arm fastening means are designed to selectively fasten the outer duct pivot arm. The volume damper adjustment tool comprises a rotatable inner elongate member, a rotatable outer elongate member, and bushing means. The inner elongate member comprises a first inner member end, a second inner member end, an inner member length, an inner member axis, and an outer member surface. The first inner member end comprises first fastener adjustment means. The outer elongate member comprises a first outer member end, a second outer member end, an outer member length, an outer member axis, and an inner member surface. The first outer member end comprises pivot arm adjustment means.

The bushing means are cooperatively associated with the first outer member end, the second outer member end, and the outer member surface for enabling the outer member surface to purposefully (under forces applied to the parts) move relative to the inner member surface and for maintaining the inner and outer member axes in substantially collinear relation for forming a reach axis. The inner and outer elongate members are each selectively rotatable about the reach axis. The first fastener adjustment means are designed for adjusting the arm fastener means and the pivot arm adjustment means are designed for adjusting the outer duct pivot arm.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows:

FIG. 3(*b*) is a top perspective view of a modified socket member showing wing nut receiving grooves.

DETAILED DESCRIPTION OF THE PREFERRED EMBODIMENT

Figure 1:
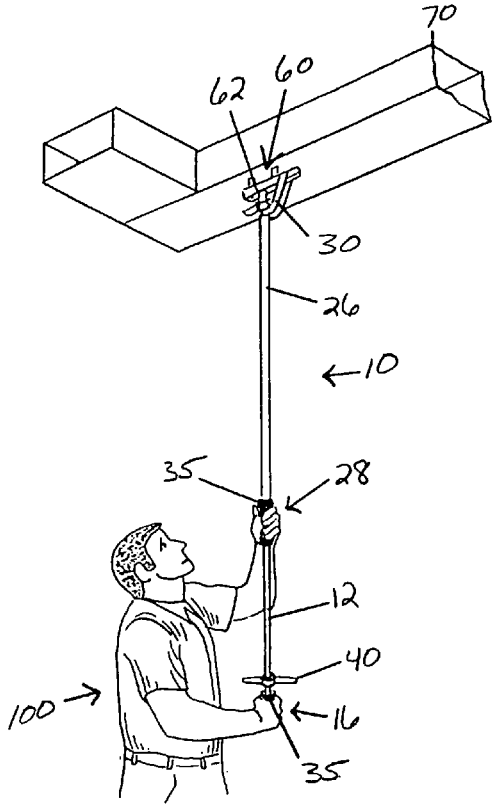
FIG. 1 is a fragmentary perspective depiction of a user adjusting a remotely situated volume damper assembly, the volume damper assembly being part of a remotely situated forced air duct system.
Figure 2:
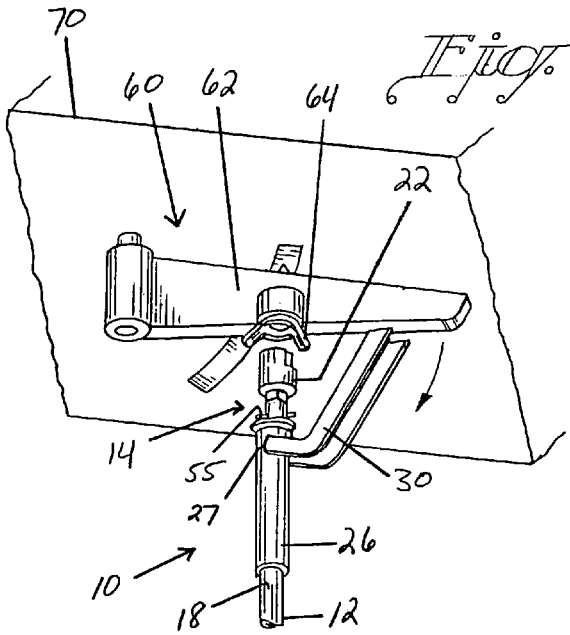
FIG. 2 is a fragmentary bottom perspective view of a first end of the volume damper adjustment tool and exterior portions of a volume damper assembly adjacent a forced air duct system.

Referring now to the drawings, the preferred embodiment of the present invention concerns a tool for adjusting hard-to-reach air volume damper assemblies. As previously noted, forced air ductwork commonly comprises damper assemblies, which can be adjusted as a means to direct variable airflows or air volume(s) through forced air ductwork, registries and/or outlets. FIG. 1 generally depicts a user adjusting a volume damper assembly, the volume damper assembly being part of a forced air duct system 70 in a vertically remote location. FIG. 2 is a general close-up depiction of the junction site between the damper adjustment tool 10 of the present invention and the exterior portions or outer portions of a volume damper assembly 60. Damper adjustment tool 10 enables a user (as referenced at 100) to adjust any number of remotely situated or remote damper assemblies.

It is contemplated that damper assembly 60, the exterior portions or outer portions of which are illustrated and referenced in FIGS. 1 and 2, preferably comprises inner duct damper means (not specifically illustrated) and an outer duct pivot arm 62 as further illustrated and referenced in FIGS. 1 and 2. Outer duct pivot arm 62 preferably comprises arm fastening means, which arm fastening means may typically be defined by a wing nut assembly or set bolt assembly type structure. As generally depicted in FIG. 2, a wing nut 64 is threadably received on a threaded member and thus may be operated to releasably tighten outer duct pivot arm 62 in fixed placement. Outer duct pivot arm 62 is designed to adjust the inner duct damper means for varying the amount or volume of air otherwise being forced through forced air duct system 70. It will thus be understood that the arm fastening means, as hereinabove exemplified, operate to selectively fasten outer duct pivot arm 62. It is believed that damper assemblies of the described type are common in the art and no further description thereof is here required.

From a general inspection of FIG. 1, it will be seen that forced air duct system 70 and similar other duct systems are often situated in remote locations, whether vertically remote or horizontally remote. FIG. 1 generally depicts a vertically remote location. The on-site technician or damper assembly adjuster may find it difficult to reach the noted remote damper assemblies without utilizing a ladder or some other means for bringing the technician closer to damper assembly 60. In some cases, other existing structure is situated below or adjacent the damper assembly 60 and the use of a ladder is ill-advised since it may be impossible to otherwise position a ladder or similar other structure directly beneath the damper assembly in need of adjustment. Similarly, forced air duct systems 70 that are situated horizontally distant or horizontally remote from the technician (as opposed to vertically distant as generally depicted in FIG. 1) pose similar problems. Damper adjustment tool 10 is designed so that users thereof may reach and adjust the remotely situated damper assemblies given the extended or elongate nature of the tool.

Figure 3A:
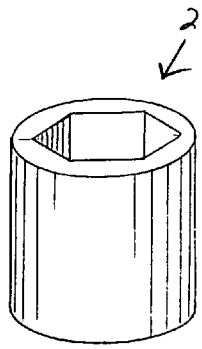
FIG. 3(*a*) is a top perspective view of a socket member.
Figure 3B:
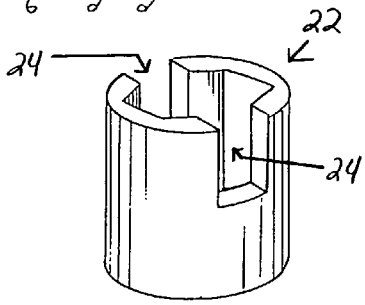
Figure 4:
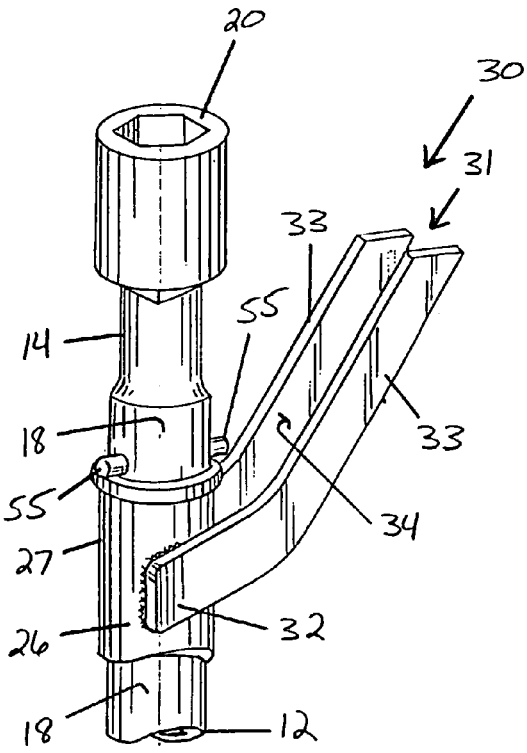
FIG. 4 is a fragmentary top perspective view of the first end of the volume damper adjustment tool.
Figure 5:
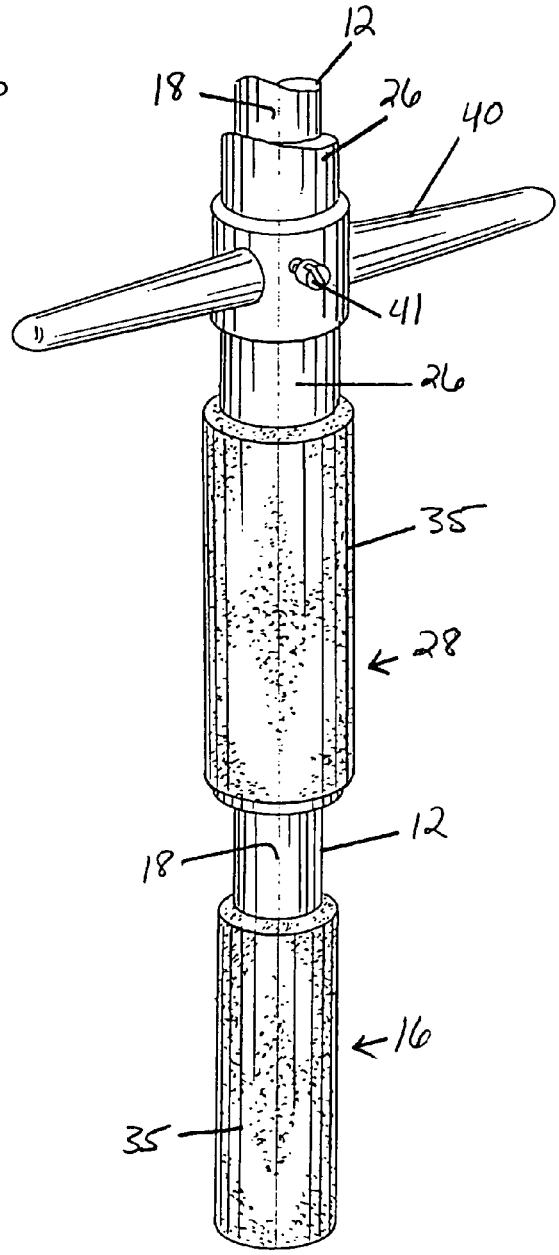
FIG. 5 is a fragmentary top perspective view of a second end of the volume damper adjustment too.

It will be seen that damper adjustment tool 10 preferably comprises a rotatable inner elongate member 12 as illustrated and referenced in FIGS. 1, 2, and 4–6. Inner elongate member 12 preferably comprises a first inner member end 14 as generally referenced in FIGS. 2 and 4; a second inner member end 16 as generally illustrated and referenced in FIGS. 1 and 5; an inner member length (as generally seen from an inspection of FIG. 1); an inner member axis (not specifically illustrated or referenced); and an outer member surface 18 as generally referenced in FIGS. 2, and 4–6. It will be seen from an inspection of FIGS. 2 and 4 that first inner member end 14 comprises first fastener adjustment means, which first fastener adjustment means may be defined by a traditional socket member 20 as generally illustrated and referenced in FIG. 3(*a*). Socket member 20 is further illustrated in FIG. 4. As earlier noted, the typical arm fastening means may be defined by a wing nut 64 receivable upon a threaded member. In this regard, it is contemplated that an otherwise typical socket member 20 can be modified to provide wing nut socket 22 as generally illustrated and referenced in FIG. 3(*b*). From an inspection of FIG. 3(*b*) it will be seen that wing nut-receiving grooves 24 may be formed in the walls of the wing nut socket 22 as a means to receive the "wings" of wing nut 64 and thus be able to more properly fasten commonly utilized wing nut assemblies. Wing nut socket 22 is further illustrated and referenced in FIG. 2.

Notably, the first fastener adjustment means (the socket or similar other structure) is interchangeable with at least one second fastener adjustment means, the second fastener adjustment means for adjusting the arm fastening means. For example, socket member 20 may be interchanged with wing nut socket 22 as may be required. Thus, damper adjustment tool 10 is operable in combination with any number of remote damper assemblies 60 given various fittings as may defined the first and second fastener adjustment means.

Preferably disposed radially adjacent inner elongate member 12 is a rotatable outer elongate member 26 as illustrated and referenced in FIGS. 1, 2, and 4–6. Outer elongate member 26 preferably comprises a first outer member end 27 as illustrated and referenced in FIGS. 2 and 4; a second outer member end 28 as illustrated and referenced in FIGS. 1 and 5; an outer member length (as generally seen from an inspection of FIG. 1), an outer member axis (not specifically illustrated or referenced), and an inner member surface 29 as referenced in FIG. 6. First outer member end 27 preferably comprises pivot arm adjustment means, which adjustment means may be defined by comprising a "torque fork" 30 as illustrated and referenced in FIGS. 1, 2, and 4. Torque fork 30 preferably comprises an arm-engaging prong end 31 and a member-engaging end 32 as generally illustrated and referenced in FIG. 4. Member-engaging end 32 is preferably fixedly attached to or integrally formed with first outer member end 27. It will be seen from an inspection of the noted figure that arm-engaging prong end 31 preferably comprises two adjacent prongs 33 and an arm-receiving groove 34, arm-receiving groove 34 extending intermediate prongs 33 for receiving outer duct pivot arm 62. Prongs 33 and arm-receiving groove 34 are specifically illustrated and referenced in FIG. 4.

It is contemplated that both inner elongate member 12 and outer elongate member 26 are constructed from rigid materials so as to enable the user to maintain a certain fixed reach axis (so that the members 12 and 26 do not otherwise bend under their own weight) and to withstand torque forces necessarily required to fasten or release the noted arm fastening means and further to adjust (pivot) the pivot arm 62. In this regard, it is contemplated that the inner and outer elongate members 12 and 26 may preferably be constructed from steel or plastic conduit of varying diameters (inner elongate member 12 being telescopically received in outer elongate member 26 as will be generally understood from an inspection of FIGS. 1, 2, and 4–6).

In this regard, it will be noted that in the preferred embodiment, damper adjustment tool 10 is substantially circular in cross-section, and thus inner elongate member 12 preferably comprises a substantially uniform circular transverse inner cross-section and outer elongate member 26 comprises a substantially uniform circular transverse outer cross-section, the inner and outer cross-sections being concentric about the preferably collinear inner member and outer member axes. Notably, it is contemplated that the inner member length is greater in magnitude than the outer member length and torque fork 30 may extend upwardly from first outer member end 27 so as to more properly engage outer duct pivot arm 62.

In this last regard, it is contemplated that damper adjustment tool 10 may further preferably comprise bushing means, which bushing means are preferably cooperatively associated with first outer member end 27, second outer member end 28, and outer member surface 18 for enabling outer member surface 18 to move relative to inner member surface 29. In this regard, it is contemplated that under the weight of members 12 and 16, no translational or rotational movement will occur. However, if forces are directed against either of the members 12 and 26, then the force may operate to translate or rotate the member against which the force is applied, the movement being relative to the non-engaged member. The bushing means are further designed to maintain the inner and outer member axes in substantially collinear relation.

Figure 6:
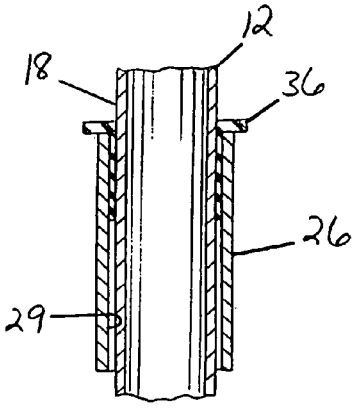
FIG. 6 is a fragmentary cross-sectional side view of an inner elongate member, an outer elongate member, and a bushing member.

The bushing means may preferably be defined by first and second (nylon) collar members 36, the first collar member 36 extending from inner member surface 29 at first outer member end 27 to outer member surface 18 as generally depicted in FIG. 6. Similarly, the second collar member 36 extends from inner member surface 29 at second outer member end 28 to outer member surface 18. Together the collar members 36 provide a modest static frictional force that will hold inner member surface 29 stationary relative to outer member surface 18 unless and until outside forces are directed against either inner elongate member 12 or outer elongate member 26 as previously described. In other words, it is contemplated that neither inner elongate member 12 nor outer elongate member 26 will translate parallel to the reach axis or rotate around the reach axis under their own weight given the static frictional forces at the collar members 36 against inner member surface 29 and outer member surface 18. Further, the first and second outer member ends 27 and 28 may be fixedly attached to collars 36 at the outer radial surfaces of collars 36 to prevent translation of collars 36 parallel to the reach axis relative to outer elongate member 26.

The collinear inner and outer member axes thus cooperatively form a reach axis, about which inner and outer elongate members 12 and 26 are selectively rotatable. In other words, inner elongate member 12 may be turned/manipulated with a user's hand (as generally depicted in FIG. 1) to fasten or unfasten the arm fastening means, the revoluation being about the inner member axis (i.e. the reach axis). The reader is redirected to FIG. 1 wherein it will be seen that the user's right hand is depicted as turning inner elongate member 12 about the inner member axis. Further, outer elongate member 26 may be turned/manipulated with a user's hand to pivot or adjust the pivot arm 62 (the pivot arm 62 being received intermediate prongs 33 in arm-receiving groove 34) and thereby adjust the inner damper means for redirecting the airflow or volume of air otherwise passing through forced air duct system(s) 70. Thus, it will be understood that the fastener adjustment means are designed for adjusting the arm fastener means and the pivot arm adjustment means are designed for adjusting the outer duct pivot arm. The damper adjustment tool 10 thus enables the user to adjust the remote damper assembly 60.

It is contemplated that damper adjustment tool 10 may comprise additional features and the following specifications are directed thereto. For example, as illustrated and referenced in FIGS. 1 and 5, it is contemplated that damper adjustment tool 10 may comprise hand grips 35 or other grip means at second inner member end 16 and/or second outer member end 28. It is contemplated that hand grips 35 or other grip means function primarily to enhance the user's ability (e.g. by increasing the coefficient of static friction) to selectively rotate inner elongate member 12 and/or outer elongate member 26 about the reach axis. A secondary function of hand grips 35, if utilized, is to provide bulky structure for attachment to inner elongate member 12 so that outer elongate member 26 does not otherwise translate past second inner member end 16. In other words, it is contemplated that hand grip 35, when attached to second inner member end 16, provides mechanical stop structure for preventing outer elongate member 26 from becoming otherwise telescopically disengaged from inner elongate member 12.

In this last regard, it will be further seen that damper adjustment tool 10 may comprise telescopic tube-retaining means. The telescopic tube-retaining means may thus be defined by hand grips 35 or similar other mechanical strop structure. For example, telescopic tube-retaining means of damper adjustment tool 10 may be defined by comprising hand grip 35 as attached to second inner member end 16. As a further example, it is contemplated that first inner member end 14 may comprise outwardly-projecting knobs 55 as illustrated and referenced in FIGS. 2 and 4. From an inspection of the noted figures, it will be seen that knobs 55 prevent outer elongate member 26 from translating past first inner member end 14. It is contemplated that knobs 55 are preferably integrally formed with outer member surface 18 and project radially outward a sufficient distance so as to prevent outer elongate member 26 from passing through the longitudinal axes of knobs 55. Further, it is contemplated that the fastener adjustment means may further define the telescopic tube-retaining means in those cases where the fastener adjustment means is sufficiently bulky to provide mechanical stop structure at first inner member end 14.

Further, damper adjustment tool 10 may comprise a select elongate member, the select elongate member being selected from the group consisting of inner elongate member 12 and outer elongate member 26. In this regard, it is contemplated that the select elongate member (either inner elongate member 12 or outer elongate member 26) may preferably comprise torque-increase means, the torque-increase means for enhancing the user's ability to selectively rotate the select elongate member. In other words, it is contemplated that the arm fastening means or outer duct pivot arm 62 may require added torque forces to become loosened, to be rotated, or to be pivoted so as to unfasten the otherwise fastened structures. The frictional forces between the user's hands and the elongate members 12 and 26 or the frictional forces between the user's hands and the grip means may not be sufficient to unfasten the noted structures (given that the torque forces are transmitted from the second member ends 16 and 28 to the first member ends 14 and 27). Thus, it is contemplated that the torque-increase means may preferably be defined by hand grip means, hand grips 35 or by a torque arm 40, the latter of which is generally illustrated and referenced in FIGS. 1 and 5.

In this last regard, it is contemplated that the select elongate member may comprise a select member end, the select member end being selected from the group consisting of second inner member end 16 and second outer member end 28 (i.e. either second inner member end 16 or second outer member end 28). The torque-increase means, or preferably torque arm 40, may thus be cooperatively associated with the select member end and provide the user with additional torque forces to rotate either the arm fastening means or outer duct pivot arm 62. It is further contemplated that torque arm 40 may preferably be interchangeable with second inner member end 16 and second outer member end 28, although it is depicted as being attached to second outer member end 28 in FIG. 5. Notably, a set screw 41 fastens torque arm 40 to second outer member end 28 and, if set screw 41 is removed or otherwise unfastened, it is contemplated that torque arm 40 may be repositioned upon second inner member end 16.

While the above description contains much specificity, this specificity should not be construed as limitations on the scope of the invention, but rather as an exemplification of the invention. For example, it is contemplated that the present invention essentially discloses a tool assembly for enabling a user to adjust a selectively fastenable pivot arm, the pivot arm comprising arm fastening means for selectively fastening the pivot arm. The tool assembly may thus essentially comprise a rotatable inner member and an outer rotatable member. The inner member comprises a first inner member end, a second inner member end, an inner member axis, and an outer member surface, the first inner member end comprising fastener adjustment means. The outer member comprises a first outer member end, a second outer member end, an outer member axis, and an inner member surface, the first outer member end comprising pivot arm adjustment means.

The outer member surface is movable relative to the inner member surface, the inner and outer member axes being substantially collinear for forming a reach axis. The inner and outer members are each selectively rotatable about the reach axis, the fastener adjustment means for adjusting the arm fastener means and the pivot arm adjustment means for adjusting the pivot arm. The fastener adjustment means may be adaptable for cooperatively associating with a plurality of arm fasteners so as to enable the tool assembly to be operable in combination with a plurality of pivot arm assemblies.

Thus, the present invention discloses a tool assembly for enabling a user to selectively pivot a select pivot structure, the select pivot structure being selected from the group comprising a first pivot structure (e.g. arm fastening means) and a second pivot structure (e.g. a pivot arm). The tool assembly comprises a rotatable inner member and a rotatable outer member, the inner member comprising an exposed inner member end (e.g. first inner member end 14) and an inner member axis. The inner member end comprises first pivot structure adjustment means (e.g. socket member 20 or wing nut socket 22). The outer member comprises an exposed outer member end (e.g. first outer member end 27) and an outer member axis. The outer member end comprises second pivot structure adjustment means. The inner and outer member axes are substantially collinear thus forming a select pivot axis (e.g. a reach axis). The inner and outer members are each selectively rotatable about the select pivot axis, the first pivot structure adjustment means for pivotally adjusting the first pivot structure and the second pivot structure for pivotally adjusting the second pivot structure. The first pivot structure is selectively pivotable as a means to selectively fasten the second pivot structure.

Accordingly, although the invention has been described by reference to a preferred embodiment and a number or alternative features, it is not intended that the novel assembly be limited thereby, but that modifications thereof are intended to be included as falling within the broad scope and spirit of the foregoing disclosure, the following claims and the appended drawings.

I claim:

1. A damper adjustment tool, the damper adjustment tool for enabling a user to adjust at least one remote damper assembly, the damper assembly comprising inner duct damper structure and an outer duct pivot arm, the outer duct pivot arm comprising arm fastening structure, the outer duct pivot arm for adjusting the inner duct damper structure, the arm fastening structure for selectively fastening the outer duct pivot arm, the damper adjustment tool comprising:

a rotatable inner elongate member, the inner elongate member comprising a first inner member end, a second inner member end, an inner member length, an inner member axis, and an outer member surface, the first inner member end comprising first fastener adjustment means for adjusting the arm fastening structure;

a rotatable outer elongate member, the outer elongate member comprising a first outer member end, a second outer member end, an outer member length, an outer member axis, and an inner member surface, the first outer member end comprising pivot arm adjustment means for adjusting the outer duct pivot arm; and bushing means, the bushing means being cooperatively associated with the first outer member end, the second outer member end, and the outer member surface for enabling the outer member surface to move relative to the inner member surface and for maintaining the inner and outer member axes in substantially collinear relation thus forming a reach axis, the inner and outer elongate members each being selectively rotatable about the reach axis.

2. The damper adjustment tool of claim 1 wherein the inner member length is greater in magnitude than the outer member length.

3. The damper adjustment tool of claim 2 wherein the second inner member end and the second outer member end comprise grip means, the grip means for enhancing the user's ability to selectively rotate the inner elongate member and the outer elongate member about the reach axis.

4. The damper adjustment tool of claim 2 comprising a select elongate member, the select elongate member being selected from the group consisting of the inner elongate member and the outer elongate member, the select elongate member comprising torque-increase means, the torque-increase means for enhancing the user's ability to selectively rotate the select elongate member.

5. The damper adjustment tool of claim 4 wherein the select elongate member comprises a select member end, the select member end being selected from the group consisting of the second inner member end and the second outer member end, the torque-increase means being defined by a torque arm, the torque arm being cooperatively associated with the select member end.

6. The damper adjustment tool of claim 5 wherein the torque arm is interchangeable with the second inner member end and the second outer member end.

7. The damper adjustment tool of claim 1 wherein the pivot arm adjustment means is defined by a torque fork, the torque fork comprising an arm-engaging prong end and a member-engaging end, the member-engaging end being fixedly attached to the first outer member end, the arm-engaging prong end comprising two adjacent prongs and arm-receiving groove, the arm-receiving groove intermediate the prongs for receiving the outer duct pivot arm.

8. The damper adjustment tool of claim 1 wherein the inner elongate member comprises a substantially uniform circular transverse inner cross-section and the outer elongate member comprises a substantially uniform circular transverse outer cross-section, the inner and outer cross-sections being concentric about the reach axis.

9. The damper adjustment tool of claim 1 wherein the bushing means is defined by first and second collar members, the first collar member extending from the inner member surface at the first outer member end to the outer member surface, the second collar member extending from the inner member surface at the second member end to the outer member surface.

10. The damper adjustment tool of claim 1 wherein the first fastener adjustment means is interchangeable with at least one second fastener adjustment means, the second fastener adjustment means for adjusting the arm fastening means, the damper adjustment tool thus being operable in combination with a plurality of remote damper assemblies.

11. A tool assembly, the tool assembly for enabling a user to adjust a selectively fastenable pivot arm, the pivot arm comprising arm fastening structure, the arm fastening structure for selectively fastening the pivot arm, the tool assembly comprising:

a rotatable inner member, the inner member comprising a first inner member end, a second inner member end, an inner member axis, and an outer member surface, the first inner member end comprising fastener adjustment means for adjusting the arm fastening structure; and a rotatable outer member, the outer member comprising a first outer member end, a second outer member end, an outer member axis, and an inner member surface, the first outer member end comprising pivot arm adjustment means for adjusting the pivot arm, the outer member surface being movable relative to the inner member surface, the inner and outer member axes being substantially collinear thus forming a reach axis, the inner and outer members each being selectively rotatable about the reach axis.

12. The tool assembly of claim 11 comprising bushing means, the bushing means being cooperatively associated with the first outer member end, the second outer member end, and the inner member surface for maintaining the inner and outer member axes in substantially collinear relation.

13. The tool assembly of claim 11 wherein the second inner member end and the second outer member end comprise grip means, the grip means for enhancing the user's ability to selectively rotate the inner member and the outer member about the reach axis.

14. The tool assembly of claim 11 comprising a select member, the select member being selected from the group consisting of the inner member and the outer member, the select member comprising torque-increase means, the torque-increase means for enhancing the user's ability to selectively rotate the select elongate member.

15. The tool assembly of claim 14 wherein the select member comprises a select member end, the select member end being selected from the group consisting of the second inner member end and the second outer member end, the torque-increase means being defined by a torque arm, the torque arm being cooperatively associated with the select member end.

16. The tool assembly of claim 15 wherein the torque arm is interchangeable with the second inner member end and the second outer member end.

17. The tool assembly of claim 11 wherein the pivot arm adjustment means is defined by a torque fork, the torque fork comprising an arm-engaging end, the arm-engaging end comprising two adjacent prongs and arm-receiving groove, the arm-receiving groove extending intermediate the prongs for receiving the pivot arm.

18. The tool assembly of claim 12 wherein the bushing means is defined by first and second collar members, the first collar member extending from the inner member surface at the first outer member end to the outer member surface, the second collar member extending from the inner member surface at the second member end to the outer member surface.

19. The tool assembly of claim 11 wherein the fastener adjustment means is adaptable for cooperatively associating with a plurality of arm fasteners, the tool assembly thus being operable in combination with a plurality of pivot arm assemblies.

* * * * *